US010537924B2

(12) United States Patent
Bruhnke

(10) Patent No.: US 10,537,924 B2
(45) Date of Patent: Jan. 21, 2020

(54) EXTRUSION PRESS FOR PRODUCING FLAT SHEETS

(71) Applicant: Ulrich Bruhnke, Ehningen (DE)

(72) Inventor: Ulrich Bruhnke, Ehningen (DE)

( * ) Notice: Subject to any disclaimer, the term of this patent is extended or adjusted under 35 U.S.C. 154(b) by 459 days.

(21) Appl. No.: 15/030,340

(22) PCT Filed: Oct. 7, 2014

(86) PCT No.: PCT/DE2014/000488
§ 371 (c)(1),
(2) Date: Aug. 15, 2016

(87) PCT Pub. No.: WO2015/055160
PCT Pub. Date: Apr. 23, 2015

(65) Prior Publication Data

US 2016/0354819 A1 Dec. 8, 2016

(30) Foreign Application Priority Data

Oct. 16, 2013 (DE) ..... 10 2013 017 178

(51) Int. Cl.
*B21C 25/04* (2006.01)
*B21C 23/06* (2006.01)
*B21C 23/00* (2006.01)
*B21C 23/01* (2006.01)

(52) U.S. Cl.
CPC ..... *B21C 23/06* (2013.01); *B21C 23/002* (2013.01); *B21C 23/01* (2013.01); *B21C 25/04* (2013.01)

(58) Field of Classification Search
CPC ..... B21C 23/01; B21C 23/06; B21C 23/183; B21C 23/217; B21C 25/04; B21C 29/04; B21C 35/023; B21C 35/026; B21C 23/04; B21C 23/085; B21C 23/14; B21C 25/025; B21D 25/025
See application file for complete search history.

(56) References Cited

U.S. PATENT DOCUMENTS 1,423,361 A * 7/1922 Rockwell ..... B21C 23/06 29/33 C
2,133,874 A * 10/1938 Sparks ..... B21C 23/06 29/17.2
2,320,071 A * 5/1943 Frothingham ..... B21C 23/218 72/256
2,798,286 A * 7/1957 Anderson ..... B21C 23/06 29/423
3,028,007 A * 4/1962 Arenz ..... B21C 29/04 72/265

(Continued)

FOREIGN PATENT DOCUMENTS

CH 107911 A 1/1925
DE 426768 3/1926

(Continued)

*Primary Examiner* — Edward T Tolan
(74) *Attorney, Agent, or Firm* — Smartpat PLC

(57) ABSTRACT

An extrusion press for producing flat metal sheets from hollow sections made of magnesium or magnesium alloys, comprising a mandrel head protruding into the die opening of an extrusion tool, wherein the mandrel head (7) of the mandrel (5) is disposed so as to protrude from the outside into the opening of the die, and the mandrel head (7) has a conical design.

6 Claims, 1 Drawing Sheet

(56) References Cited

U.S. PATENT DOCUMENTS

| | | | | | |
|---|---|---|---|---|---|
| 4,138,871 | A * | 2/1979 | Kawano | B21C 23/007 | 72/269 |
| 4,703,639 | A | 11/1987 | Fuchs, Jr. | | |
| 5,687,604 | A * | 11/1997 | Robbins | B21C 23/217 | 72/265 |
| 5,870,921 | A * | 2/1999 | Piccinin | B21C 25/00 | 72/269 |
| 5,964,120 | A * | 10/1999 | Iwase | B21C 25/025 | 72/272 |

FOREIGN PATENT DOCUMENTS

| | | | | | |
|---|---|---|---|---|---|
| DE | 443060 | C | 4/1927 | | |
| DE | 1783110 | B1 * | 3/1971 | B21C 23/22 | |
| DE | 26 17 616 | | 11/1977 | | |
| DE | 24 46 308 | | 11/1983 | | |
| DE | 28 48 274 | | 4/1984 | | |
| DE | 4023737 | A1 * | 1/1992 | B21C 23/04 | |
| DE | 198 42 293 | | 6/2003 | | |
| DE | 102 15 056 | | 10/2003 | | |
| GB | 208562 | | 7/1925 | | |
| JP | 56-45209 | A * | 4/1981 | B21C 23/14 | |

* cited by examiner

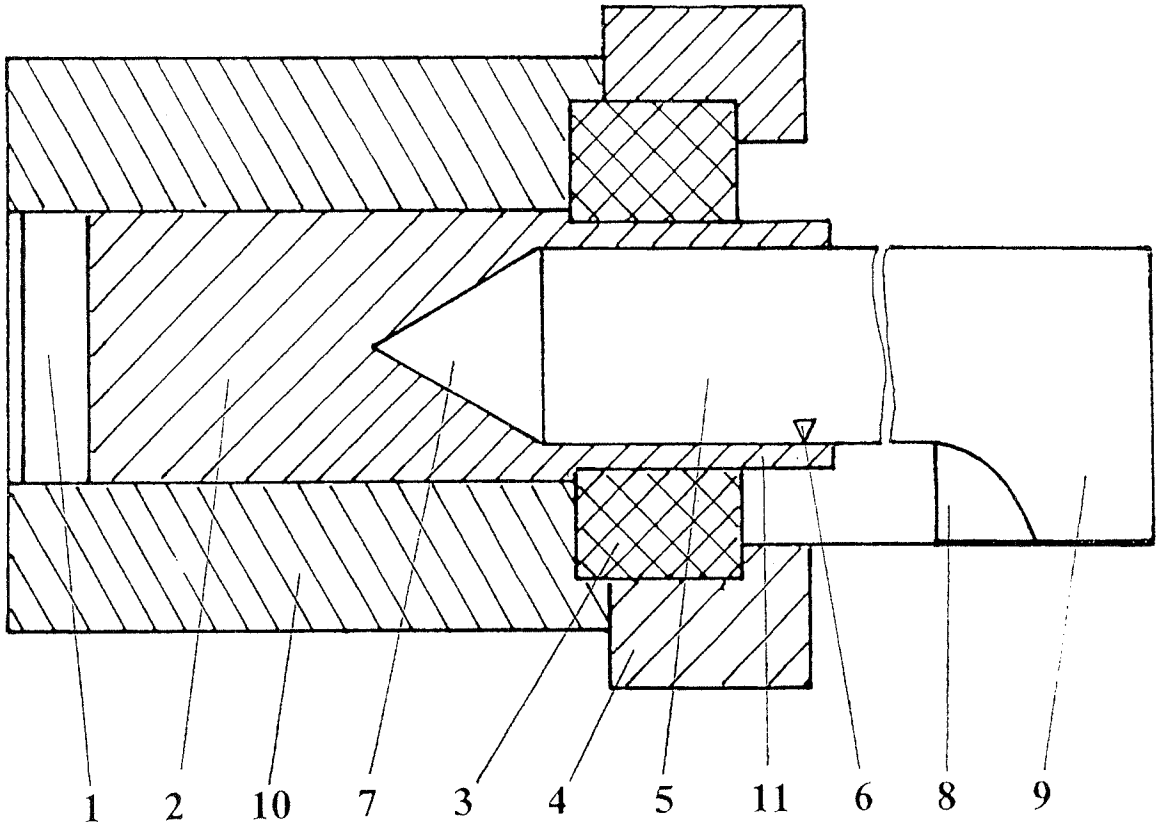
1
2
10
7
3
4
5
11
6
8
9

EXTRUSION PRESS FOR PRODUCING FLAT SHEETS

The invention relates to an extrusion press for producing flat metal sheets from hollow sections made of magnesium or magnesium alloys, comprising a mandrel head protruding into the die opening of an extrusion tool.

Extrusion presses for producing hollow sections are sufficiently known and operate based on various extrusion methods, such as by way of fixed mandrels or punching the round billet in the press.

An extrusion press is known from DE 102 15 056 A1 which operates according to the principle of punching the round billet. This press comprises a piercing plug, which is disposed in the moving crosshead, and a shaping die, which is inserted in a die holder, wherein a tube is extruded from a billet through a gap formed between the piercing plug and the die.

In extrusion, the material of a round billet, having become ductile, is pressed by a stem, or by way of a liquid in the case of hydrostatic extrusion, from a container through one or more extrusion cross-sections of a tool traversing the extrusion direction.

To produce hollow sections, hollow dies comprising a die plate are used in the extrusion process. The die plate is integrated in a mandrel part to shape the outer contour of the section. In order to shape the inner contour, the mandrel is arranged in this part such that the mandrel projects into the die plate and beyond the shaping region of the same. The ductile material is conducted via inlets into the extrusion tool so that the partial strands from the individual inlets flow together again under mandrel support arms in a fusing chamber and are fused together. During the further extrusion process, the material flows past the mandrel and the die opening, thereby adopting the intended shape of the hollow section.

Such a tool for extruding hollow sections is known from DE 24 46 308 C2, for example. The size of the hollow section that can be produced is limited by the container diameter, the size of the inlets disposed on the outside around the cavity, and the load-bearing capacity of the mandrel support arms.

A porthole die for extrusion presses is known from DE 28 48 274 C2, which is composed of a two-part die, the first part of which has an opening that determines the outer contour of the profile and the second part of which has a mandrel pin connected to the base body via bridge parts, the peripheral surfaces of the mandrel pin determining the inner cross-section of the profile. An inlet chamber, which is centered relative to the mandrel pin, is provided on the side facing the container, the bottom surface of which is formed by the end face of the mandrel pin that is set back in the extrusion direction, wherein, proceeding from the bottom surface, the upper end faces of the bridge parts are designed to ascend obliquely in the direction of the container up to the wall of the inlet chamber.

From DE 198 42 293 C2, a method for extruding a hollow section or similar body from a billet, and a device therefor, are known. The billet is guided in a container hole of a holder and fed, by way of a stem, in the extrusion direction to a shaping cross-section of a shaping tool, wherein the billet material is introduced under pressing pressure into a central inlet of the shaping tool, and the resultant ductile mass is conducted, at an angle to the extrusion direction, outwardly through several channels to a large fusing chamber and is guided to the shaping cross-section.

The disadvantage of previously known approaches is that the material flow is divided by the bridge parts by way of which the mandrels are attached, and thus has to flow around the same, and subsequently re-unite in the fusing chamber to form an overall material flow. This can result in imperfections in the material flow, which cause long profile sections to have to be removed as waste from the strand being created, including in all the resulting consequences of decreasing economic efficiency at a shrinking profile output. Furthermore, such tools having a complicated structure cannot be provided with a coating, made of a ceramic material, for example, so as to minimize friction. The previously known tools comprise bridge parts, by way of which the mandrel is held in the position thereof. Pressure and friction forces act on the mandrel and on the bridge parts in the extrusion direction. The pressure and friction forces, which are of additive in nature, act on the die part carrying the mandrel but can only be supported on the outer edge of the die part. The die part therefore experiences a high bending moment, together with a corresponding deformation, that also acts on the transition from the mandrel to the bridge parts. These stresses can also result in deformations and cracking here, since the bridge parts, on which the mandrel is mounted, bend in the extrusion direction under load.

Proceeding from the prior art, it was the object of the inventor to provide an extrusion press for producing flat metal sheets from hollow sections made of magnesium or magnesium alloys using a mandrel head protruding into the die opening of an extrusion die, which eliminates the aforementioned disadvantages.

This object is achieved by an extrusion press for producing flat metal sheets from hollow sections made of magnesium or magnesium alloys, which has a frame, a container configured to receive a round billet, a die, and a mandrel. The mandrel has a conical mandrel head at one end and an end region opposite the mandrel head. The mandrel is disposed so as to be held at its end region by the frame with the mandrel head protruding from the outside into an opening of the die. A flat metal sheet is formed by pressing a round billet through a gap formed between the die and the mandrel to form a tubular hollow section and subsequently forming the tubular hollow section into a flat metal sheet. When in use, material of the round billet flows along the conical mandrel head towards the gap.

According to the invention, the round billet is pressed by way of the stem against the tip of the mandrel protruding from the outside into the die. The material flow of the round billet is guided along the conical tip of the mandrel in the direction of the gap between the mandrel and the die.

This has the advantage that it is no longer necessary for the material flow to be divided by the bridge parts and subsequently re-united in the fusing chamber. This avoids imperfections which cause long profile sections to have to be removed as waste from the developing strand, and the economic efficiency is considerably improved. Furthermore, the open two-part configuration of the die and mandrel allow these to have a simple design, and the surfaces thereof can be provided with a coating made of ceramic material to reduce friction.

The invention will be described in more detail based on one exemplary embodiment. The associated FIG. 1 shows a section of the extrusion press according to the invention. The extrusion press for the direct extrusion of hollow sections, which thereafter are formed to obtain flat metal sheets, comprises a stem 1 on a pressing cylinder, the stem extending in the longitudinal axis of a borehole extending through a container 10. The container 10 accommodates the round billet 2.

The die 3, which determines the outer contour of the hollow section 11, is mounted at the end of the container 10 in a die holder 4. The mandrel head 7 of the mandrel 5 is disposed so as to protrude from the outside into the opening of the die, and more particularly with the mandrel head 7 thereof pointing in the direction of the container 10. As shown, the cylindrical mandrel 5 has a conical mandrel head 7 with a pointed tip. The mandrel 5 protrudes from the outside through an opening of the die 3 such that the conical mandrel head 7 is arranged entirely inside the container 10 axially spaced inwardly of the die 3. The mandrel 5 determines the inner contour of the hollow section 11 and has a conical design. The mandrel 5 can be provided with a cooling or heating device.

On the side facing away from the mandrel head 7, the mandrel 5 has an end region 9, by which it is attached to the frame of the extrusion press. The end region 9 of the mandrel 5 includes a expanding edge 8, which has a wing-shaped design, on the side facing the die 3. A cutting device 6, preferably a laser, is disposed between the expanding edge 8 and the die 3, preferably in the vicinity of the same, which severs the hollow section 11 along the peripheral surface thereof after exiting the die 3.

So as to produce the hollow section 11, and ultimately the flat metal sheet, the container 10 is loaded with the round billet 2, which is pressed in the direction of the die 3 by way of the stem 1. After the round billet 2 impinges on the mandrel head 7, the material flow of the round billet 2 is guided along the conical tip of the mandrel head 7, in the direction of the gap between the mandrel 5 and the die 3, and shaped into the hollow section 11.

After the hollow section 11 exits the die 3, the hollow section is severed along the peripheral surface thereof and formed into a flat metal sheet on impingement on the expanding edge 8.

LIST OF REFERENCE NUMERALS

1—stem
2—round billet
3—die
4—die holder
5—mandrel
6—cutting device
7—mandrel head
8—expanding edge
9—end region
10—container
11—hollow section

The invention claimed is:

1. An extrusion press for producing flat metal sheets from hollow sections made of magnesium or magnesium alloys, comprising:

a frame;

a container configured to receive a round billet;

a die having a cylindrical inner surface; and a cylindrical mandrel having a conical mandrel head with a pointed tip at one end and an end region opposite the conical mandrel head, the mandrel being disposed so as to be held at its end region by the frame with the mandrel protruding from outside through an opening of the die such that the conical mandrel head is arranged entirely inside the container axially spaced inwardly of the die, wherein a flat metal sheet is formed by pressing the round billet through an elongated hollow cylindrical gap formed between the cylindrical inner surface of the die and a cylindrical portion of the mandrel, axially spaced behind the conical mandrel head, to form a tubular hollow section and subsequently by forming the tubular hollow section into the flat metal sheet, and wherein material of the round billet flows along the conical mandrel head towards the gap.

2. The extrusion press according to claim 1, wherein the container and the mandrel are separately from one another attached to the frame.

3. The extrusion press according to claim 1, wherein the end region of the mandrel includes a wing-shaped expanding edge which faces the die.

4. The extrusion press according to claim 1, wherein the die and the mandrel are coated with a ceramic material.

5. The extrusion press according to claim 1, wherein the inner cylindrical surface of the die has a constant diameter along an entire length of the die.

6. The extrusion press according to claim 1, wherein the hollow cylindrical gap has a constant diameter along an entire length of the die.

* * * * *